United States Patent [19]

Shea

[11] Patent Number: 5,012,614

[45] Date of Patent: May 7, 1991

[54] BLOW-MOLDED UNITARY THERMOPLASTIC THRESHOLD

[76] Inventor: Gregory T. Shea, 8797 Birgham Ct., Dublin, Ohio 43017

[21] Appl. No.: 440,498

[22] Filed: Nov. 22, 1989

[51] Int. Cl.[5] ..... E06B 1/70

[52] U.S. Cl. ..... 49/468; 49/471

[58] Field of Search ..... 49/468, 467, 409, 471, 49/470

[56] References Cited

U.S. PATENT DOCUMENTS

| | | | |
|---|---|---|---|
| 3,079,653 | 3/1963 | Cornell | 49/469 X |
| 3,778,931 | 12/1973 | Donaldson | 49/469 X |
| 3,851,420 | 12/1974 | Tibbetts | 49/470 X |
| 3,859,754 | 1/1975 | Budich et al. | 49/471 X |
| 3,900,967 | 8/1975 | Bursk et al. | 49/468 |
| 4,310,991 | 1/1982 | Seely | 49/468 |
| 4,352,258 | 10/1982 | Bursk et al. | 49/468 |
| 4,476,653 | 10/1984 | Speer et al. | 49/468 |

*Primary Examiner*—Philip C. Kannan

*Attorney, Agent, or Firm*—Michael L. Keller

[57] ABSTRACT

The present invention is addressed to a thermoplastic threshold of unique configuration and which is manufactured by blow molding techniques. The novel thermoplastic threshold is hollow and sealed to the outside. It is of one-piece construction made by blow molding a parison of thermoplastic material. The threshold has a bottom adapted to rest on a lower horizontal jamb and has stiffener ribs disposed at the bottom. A planar tread segment is disposed to the outside. A transverse, U-shaped channel has upstanding vertical walls and is adapted to receive a sill. The bottom of the channel has apertures for receiving threaded elongate members (e.g. screws) for adjusting the height of a sill that can be disposed within the channel. The outside disposed vertical channel wall is joined about its top to an outer, sloping wall or transition wall that meets the tread segment. At predetermined locations, the bottom of the threshold is recessed upwardly to engage the bottom of the outside vertical channel wall and the sloping wall at its meeting with said tread segment. These bottom recesses have upwardly projecting side weirs disposed from the inner vertical wall to said sloping wall/tread segment meeting. There is a hole in the vertical wall at its bottom and in said sloping wall at its meeting with said tread segment for water to flow from within the channel through said holes and onto said tread segment (e.g., a weep system). The bottom or top adjacent such sealed threshold end contains a channel parallel to each end and adapted to present, with each said end, at least two walls for said threshold to be attached to vertical side jambs for its installation.

14 Claims, 3 Drawing Sheets

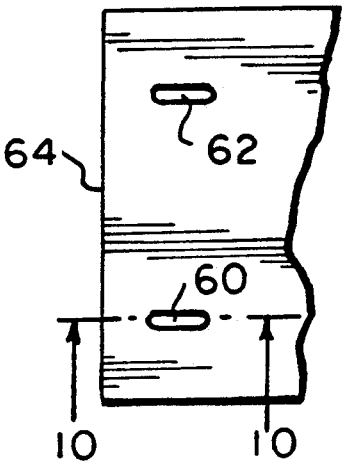
FIG. 9
FIG. 10
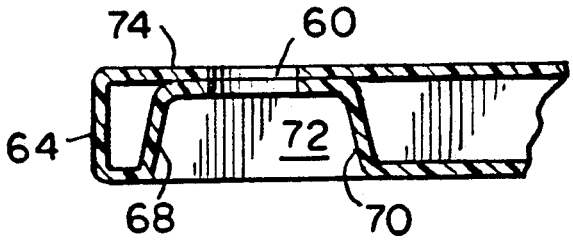
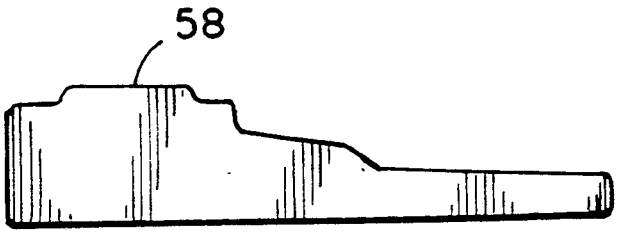
FIG. 11
FIG. 12
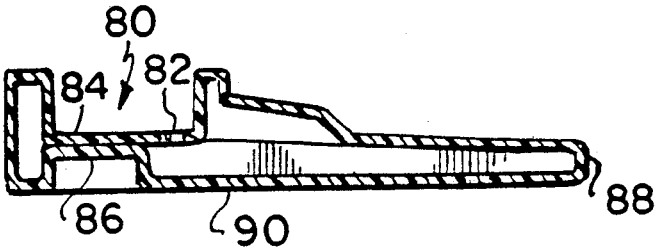

BLOW-MOLDED UNITARY THERMOPLASTIC THRESHOLD

BACKGROUND OF THE INVENTION

The present invention relates to thresholds such as are used in a doorway communicating from interior space to the outside and more particularly to a thermoplastic door threshold of unique configuration manufactured by blow molding techniques.

Thresholds, such as are associated with door assemblies, provide a transition from one space to another through a doorway (e.g. between flooring of different material and/or height) and can provide a sealing/weatherproofing barrier when the doorway provides communication between the outside and interior space. Traditionally, such "exterior" thresholds ("exterior" used in the sense of a doorway communicating to the outside environment) have been manufactured from wood, optionally clad with metal, such as aluminum. Such wooden thresholds were anchored to the lower, horizontal jamb of the door frame by means of screws. Weather-tightness can be a problem for such threshold assemblies due to weathering of the wood and the difficulty in adjusting the sill height to mate tightly against the bottom of the door.

Of more recent vintage are thresholds manufactured from thermoplastic material by conventional injection molding techniques (structural foam generation) and by extrusion techniques. Such thermoplastic thresholds provide excellent weatherability, provided that temperatures do not reach high or low extremes. Adjustable wooden sills can be accommodated by thermoplastic thresholds which is an advantage offered by using thermoplastic material. Additionally, weep systems can be provided. A weep system comprises means for channeling water that might accumulate in a channel designed to house the adjustable sill to the outside of the threshold. In this regard, U.S. Pat. Nos. 2,846,736, 3,261,130, and 3,900,967 show injection molded thermoplastic thresholds for doors. In particular, the '967 patent shows the general threshold shape and a weep system. The '130 patent shows the molding feature of threshold end pieces so screws can anchor the threshold sides to the door frame. U.S. Pat. Nos. 2,696,028, 3,778,931, and 4,104,830 show adjustable seal inserts and end wall construction of thermoplastic door thresholds. Finally, U.S. Pat. Nos. 3,360,887, 3,851,420, and 3,859,754 refer to extruded thermoplastic door thresholds.

BROAD STATEMENT OF THE INVENTION

The present invention is addressed to a thermoplastic threshold of unique configuration and which is manufactured by blow molding techniques. The novel thermoplastic threshold is hollow and sealed to the outside. It is of one-piece construction made by blow molding a parison of thermoplastic material. The threshold has a bottom adapted to rest on a lower horizontal jamb and has stiffener ribs disposed at the bottom. A planar tread segment is disposed to the outside. A transverse, U-shaped channel has upstanding vertical walls and is adapted to receive a sill. The bottom of the channel has apertures for receiving threaded elongate members (e.g. screws) for adjusting the height of a sill that can be disposed within the channel. The outside disposed vertical channel wall is joined about its top to an outer, sloping wall or transition wall that meets the tread segment. At predetermined locations, the bottom of the threshold is recessed upwardly to engage the bottom of the outside vertical channel wall and the sloping wall at its meeting with said tread segment. These bottom recesses have upwardly projecting side weirs disposed from the inner vertical wall to said sloping wall/tread segment meeting. There is a hole in the vertical wall at its bottom and in said sloping wall at its meeting with said tread segment for water to flow from within the channel through said holes and onto said tread segment (e.g., a weep system). The bottom or top adjacent each sealed threshold end contains a channel parallel to each end and adapted to present, with each said end, at least two walls for said threshold to be attached to vertical side jambs for its installation.

Advantages of the present invention include the ability to manufacture the novel thermoplastic thresholds reliably, reproduceably, and in high volume due to the use of blow molding for its manufacture. Another advantage is that the threshold is unitary or one-piece in construction, and is hollow. A further advantage is that the hollow threshold is sealed to outside weather conditions. Another advantage is the ability to tack-off sections of the bottom for providing stiffener ribs for maintaining structural integrity of the threshold. Yet another advantage is the integrally-formed sealed ends which are formed into a "nailing system" of at least two walls for ensuring secure and extended installation of the novel threshold. These and other advantages will be readily apparent to those skilled in the art based upon the disclosure contained herein.

BRIEF DESCRIPTION OF THE DRAWINGS

FIG. 9 is a partial top view of an alternative nailing system for attachment of the novel thermoplastic threshold;

FIG. 10 is a cross-sectional elevational view taken along line 10—10 of FIG. 9;

FIG. 11 is an end view showing the profile for an alternative embodiment of the novel thermoplastic threshold; and FIG. 12 is a partial cross-sectional elevational view showing an alternative weep system design.

The drawings will be described in detail in connection with the following disclosure.

DETAILED DESCRIPTION OF THE INVENTION

Figure 1:
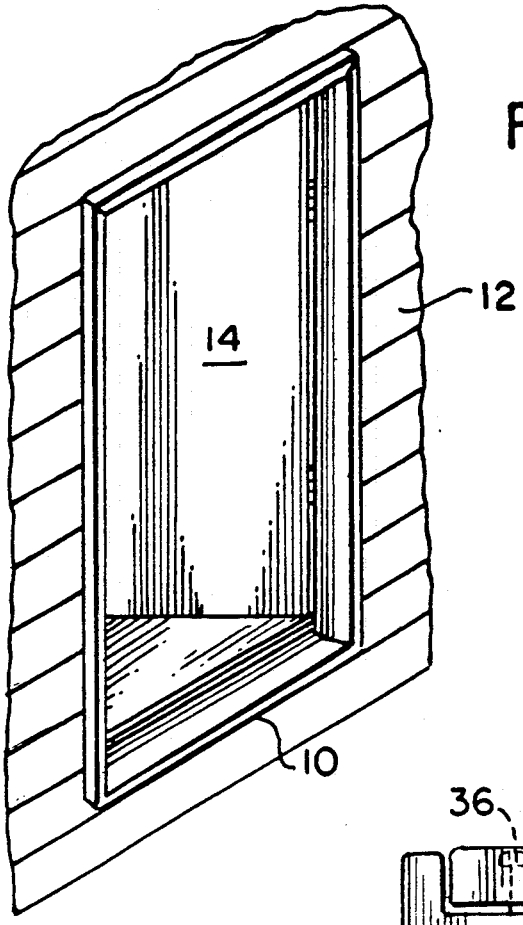
FIG. 1 is a partial, elevational view showing a door and door frame assembly installed in the side of a house wherein the novel thermoplastic threshold is seen installed.

Threshold 10 is seen in FIG. 1 to be installed within a door and frame assembly disposed in wall 12. Door 14 provides communication from an interior space to the outside and must tightly engage threshold 10 in order to provide an effective weather sealing system. In the description herein, threshold 10 will be described with respect to an "inside" as represented by the interior space where door 14 is located (see FIG. 1) and the "outside" which is in communication with the inside via the door assembly of which threshold 10 is a part.

Figure 2:
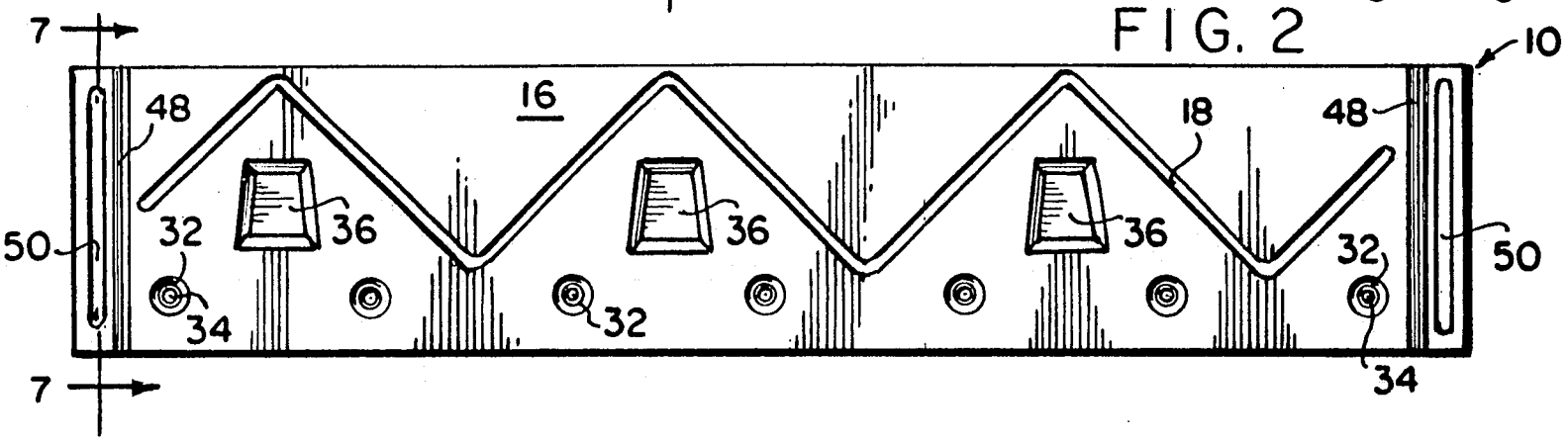
FIG. 2 is a bottom view of the novel thermoplastic threshold.

The bottom of threshold 10 is seen at FIG. 2. Bottom 16 presents a planar surface for threshold 10 to rest on the lower, horizontal door jamb (not shown in the drawings) which forms a portion of the door frame assembly. Stiffener rib system 18 is seen to be formed in a zig-zag pattern at FIG. 2. Stiffener rib 18 provides structural rigidity to threshold 10 under load-bearing conditions. It will be appreciated that stiffener rib 18 could be provided in a variety of continuous and/or discontinuous patterns depending upon the length of threshold 10, the expected load which threshold 10 will bear, and like factors.

Figure 3:
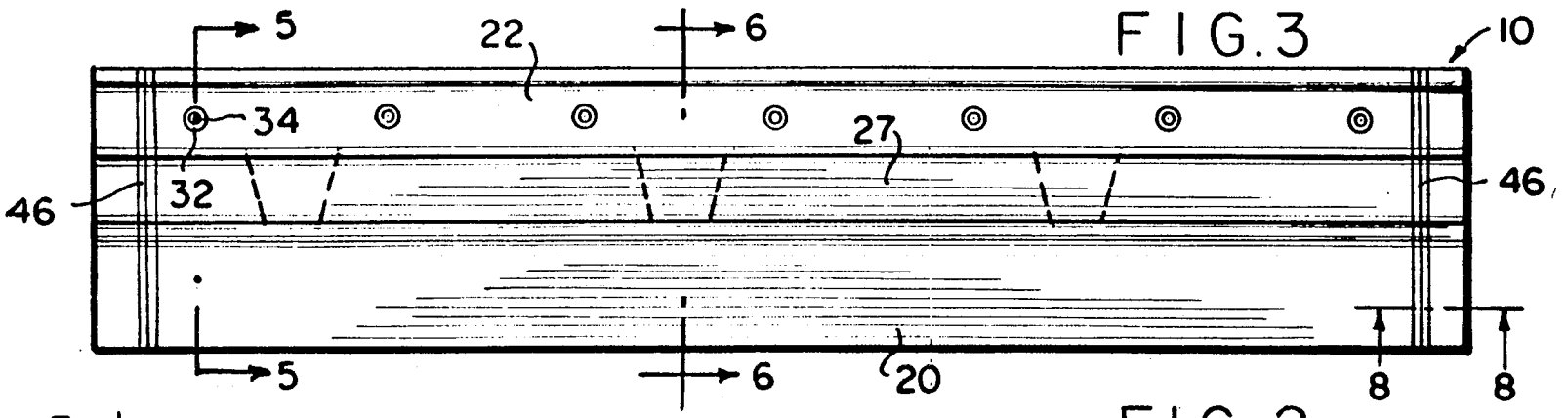
FIG. 3 is a top view of the novel thermoplastic threshold.
Figure 7:
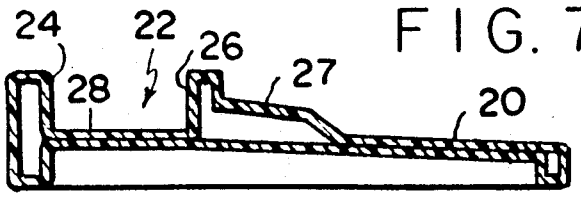
FIG. 7 is a cross-sectional elevational view taken along line 7—7 of FIG. 2.

A top view of threshold 10 is presented in FIG. 3. The top of threshold 10 generally comprises planar tread segment 20 which is disposed towards the outside and U-shaped channel 22 disposed towards the inside. Channel 22 is formed by vertical inside wall 24 and vertical outside wall 26 (see FIGS. 5 and 7). Finally, floor 28 (see FIG. 7) completes channel 22. Disposed between tread segments 20 and channel 22 is sloping wall or transition segment 27. Segment 27 is seen to run from about the top of vertical wall 26 of channel 22 to its meeting with tread segment 20 at position 30 (see FIGS. 5 and 7). Alternatively, tread segment 20 and transition segment 27 may be a continuous tread area.

Figure 4:
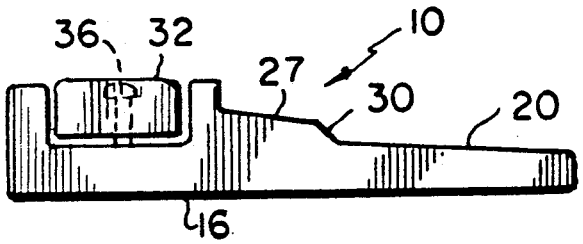
FIG. 4 is an end view of the novel thermoplastic threshold.
Figure 5:
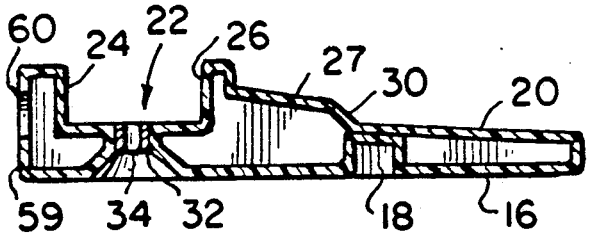
FIG. 5 is a cross-sectional elevational view taken along line 5—5 of FIG. 3.

FIG. 4 is an end view of threshold 10 which shows sill 32 disposed within channel 22. Referring to FIGS. 3, 4, and 5, it will be observed that channel 22 contains a series of inserts 32 disposed within apertures 34 molded in floor 28 of channel 22. Insert 32 (and the remaining inserts not specifically labelled) can be molded in during the blow molding procedure for manufacturing threshold 10 or can be added later at the expense of extra labor and handling operations. Insert 32 disposed in aperture 34 is designed to receive threaded elongate member 36 (e.g. preferably a screw) for providing height adjustability for sill 32 disposed within channel 22. Threaded member 36 and the remaining threaded members (not shown in the drawings) can be independently adjusted for providing sealing engagement between sill 32 and the bottom of door 14. Preferably, bottom 16 is depressed upwardly and inwardly towards floor 28 of channel 22 in forming aperture 34 and the remaining apertures. A double layer area is provided thereby for enhancing the ability of the thermoplastic material to retain insert 32 and bear the load that can be placed on it when weight is applied to sill 32 and transmitted via threaded elongate member 36 to insert 32.

Figure 6:
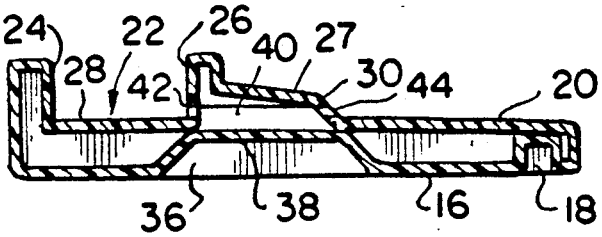
FIG. 6 is a cross-sectional elevational view taken along line 6—6 of FIG. 3.

Since the novel thermoplastic threshold is designed to be installed in a door frame system providing communication to the outside, it will be appreciated that rain water may wick its way into channel 22 when the door is closed and easily flow to within channel 22 when door 14 is opened when it is raining outside. In order for water to not accumulate in channel 22, a weep system must be provided. The details of the weep system of the novel threshold disclosed herein can be seen by reference to FIG. 6. While three weep systems are shown in FIGS. 2 and 3, it will be appreciated that more or less weep systems can be provided as is necessary, desirable, or convenient. The weep system is formed by recess 36 (see FIG. 6) that forms floor 38 running from the intersection of vertical wall 26 and floor 28 of channel 22 to meeting or intersection 30 of tread segment 20 and sloping wall 27. Weir 40 is disposed on one side of floor 38 running from vertical wall 26 to sloping wall 27 and a similar weir (not shown) is formed on the opposite side of floor 38. Essentially, a walled recess or channel has been fabricated by floor 38, weir 40, and the opposite weir not shown, along with vertical wall 26 and sloping wall 27. In order to complete the weep system flow pattern, aperture 42 is formed in vertical wall 26 at its bottom and aperture 44 is formed in sloping wall 27 at meeting 30 with tread segment 20. Thus, a flow channel from within channel 22 to the outside and on top of tread segment 20 is provided. The water flowing through this weep system cannot migrate sideways due to weir 40 and with the slight incline provided by floor 38 and tread segment 28, the flow pattern is established by gravity from channel 22 to the outside at tread segment 20. It will be appreciated that apertures 42 and 44 can be one or more in number and can be configured in a variety of shapes as is necessary, desirable, or convenient. While it is possible that apertures 42 and 44 could be molded in during the blow molding operation, it is contemplated presently to form these apertures by appropriate drilling operations after threshold 10 is removed from the blow molding operation.

Since the novel blow molded threshold is one-piece in construction and hollow, it is possible to utilize such hollowness as the basis for a weep system. An example of such an alternative design is set forth at FIG. 12 wherein channel 80 adapted to receive the sill has aperture 82 formed in floor 84 ahead of stiffener tack-off 86. Aperture 88 disposed towards the outside of the threshold permits accumulated moisture within the threshold to flow to the outside. Bottom 90 of the threshold can be inclined towards aperture 88 from tack-off 86 for providing gravity flow of water therein. Alternatively, a channel can be molded in base 90 for insuring direction and flow of water from aperture 82 through aperture 88 to the outside. A variety of weep system designs, then, can be envisioned in accordance with the present invention based upon the hollowness and unitary construction features disclosed herein.

Figure 8:
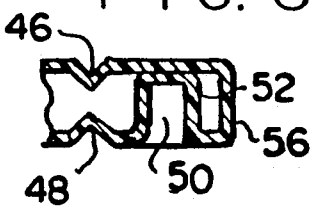
FIG. 8 is a partial cross-sectional elevational view taken along line 8—8 of FIG. 3.

With reference to FIGS. 4 and 8, it will be observed that the ends of threshold 10 are sealed to the outside. Optional molded in Vs or expansion joints 46 and 48 permit threshold 10 to expand and contract depending upon exposure temperatures primarily due to the threshold being exposed to the outside. Such expansion joints could be greater in number and smaller in size as is necessary, desirable, or convenient. Moreover, when a storm door is placed to the outside of door 14 and bright sunshine flows thereonto, temperatures within the air space between door 14 and the storm door can reach as high as around 160° F. Thus, the need for expansion capability of threshold 10 can be realized. In this regard, vents (e.g. vent 59 of FIG. 5) can be located in inside wall 60 to equilibrate the temperature inside threshold 10 with the interior space temperature.

With continued reference to FIG. 8, it will be appreciated that threshold 10 is designed for installation by being screwed or nailed to vertical door jambs (not shown) which are part of the door frame assembly shown in FIG. 1. Since this method of installation is appropriate, structural integrity of the ends must be maintained. A unique method for providing a "nailing system" for installation of threshold 10 comprises channel 50 (see FIG. 8) formed from spaced-apart walls 52 and 54 that join and mate with the upper side of threshold 10 for providing insured sealing of the ends of threshold 10 and, with end wall 56, present at least two, and possibly three (in the configuration shown at FIG. 8) walls for nails or screws to retain threshold 10 within the door frame assembly. It will be appreciated that channel 50 can be formed from bottom 16 of threshold assembly 10 or from the top, including tread section 20, sloping wall 28, and the structure of channel 22. Moreover, more than one channel can be provided as is necessary, desirable, or convenient.

An alternative "nailing system" for threshold 10 is shown in FIGS. 9 and 10. This system is designed for threshold 10 to be attached to the bottom of the vertical sills that form the door and frame assembly (shown at FIG. 1) utilizing apertures 60 and 62 through which nails (not shown) or other fasteners penetrate. The ovoid or expanded shape of apertures 60 and 62 in the lengthwise direction of threshold 10 accommodate its thermal expansion and contraction. Apertures 60 and 62 are formed by tack-offs that are inwardly disposed from end wall 64. Tack-off 66 is depicted in FIG. 10 and comprises a trapezoidally-shaped cavity formed from interior walls 68, 70, 72, and a fourth wall not shown in FIG. 10. The intersection of tack-off 66 that forms aperture 60 can be blow molded as a "kiss off" so that the thin layer of thermoplastic material originally occupying aperture 60 can be knocked out for forming aperture 60. While two apertures are shown in FIG. 9, it will be appreciated that a lesser or greater number of apertures for such a nailing system can be used as is necessary, desirable, or convenient.

When adjustable sill 32 is not required, then an end view of a unitary threshold can be seen in FIG. 11, which corresponds to the profile of the end view in FIG. 4, but for sill 58 to be molded as part of threshold 10. In this configuration, the novel end sealing and tack section depicted at FIG. 8 still is retained as well as is stiffener rib 18. No weep-system, however, is required since sill 58 is not adjustable. For patio door systems wherein one door is fixed while the other opens to the outside, the present invention permits a single threshold to be blow molded wherein the threshold for the opening door could be designed as in FIGS. 4–7 while the threshold for the fixed door could be molded in the configuration of FIG. 11 where no adjustable sill is needed. The flexibility that the present invention provides in manufacturing continuous, one-piece thresholds with sections containing different configurations surely bespeaks of the novelty thereof and distinguishes the inventive threshold from the art.

As disclosed herein, thermoplastic threshold 10 is formulated from thermoplastic material which can be selected from a wide variety of thermoplastics well known in the art. These thermoplastic materials include, for example, vinyl resins, olefins, phenoxy resins, polyimides, polyethers, polyetherimides, aromatic polyesters, polyamides, polysulfones, polycarbonates, polyacetals, polyethylene oxide resins, polystyrenes, acrylics, neoprenes, polyphenylene oxide resins, cellulose esters, and the like and mixtures thereof. Conventional additives (e.g. UV stabilizers), pigments, fillers, etc. are used to the extent of being necessary, desirable, or convenient in accordance with design requirements of the threshold and blow molding operations.

The thermoplastic material is used to manufacture threshold 10 by blow molding. Blow molding is a well-known technique employed in the manufacture of hollow plastic articles. Blow molding machines with continuously moving components facilitate high speed, high volume fabrication of hollow plastic articles at low cost. Typically, a tube or "parison" of plastic material in a hot, moldable condition is positioned between two halves of a partable mold which has a mold cavity disposed therein of a configuration appropriate for the external profile or configuration of threshold 10. The mold halves are closed around the parison and pressurized gas, e.g. typically air, is introduced into the interior of the parison to cause it to expand and conform to the shape of the mold cavity. The mold cools the plastic material to its final rigid shape. The mold then is parted, and threshold 10 removed. High volume production requirements normally dictate the parison be extruded through a die directly into position between the mold halves. Such a process is referred to as extrusion blow molding, which optionally may be used in fabricating threshold 10.

Since certain changes may be made in the invention without departing from the precepts of the invention disclosed herein, it is intended that all matter contained in the disclosure and shown in the accompanying drawings shall be interpreted as illustrative and not in a limiting sense. All citations set forth herein are expressly incorporated herein by reference.

I claim

1. A blow-molded thermoplastic threshold for attaching to a jamb assembly comprising at least two vertical jambs and a lower horizontal jamb, and having an inside and an outside, which comprises:

a hollow, sealed to the outside one-piece threshold made by blow molding a parison of thermoplastic material and having a bottom adapted to rest on a lower horizontal jamb and having a stiffener rib disposed thereat;

an integral planar tread segment disposed to the outside; and a transverse U-shaped channel having upstanding inside and outside disposed vertical channel walls, said channel adapted to receive a sill and having sill apertures for receiving threaded elongate members for adjusting the height of said sill, the outside disposed vertical channel wall being joined about its top to an outer, sloping wall that meets said tread segment; wherein at predetermined locations, said bottom being recessed upwardly to engage with the bottom of said outside vertical channel wall and with said sloping wall at its meeting with said tread segment, the bottom recesses having upwardly projecting side weirs from said inner vertical wall to said sloping wall/tread segment meeting, there being a hole in said vertical channel wall at its bottom and in said sloping wall at its meeting with said tread segment for water to flow from within said channel through said holes and onto said tread segment; the bottom or top adjacent each sealed threshold end containing an end channel parallel to each side and adapted to present with each said end at least two walls for said threshold to be attached to vertical side jambs for its installation.

2. The threshold of claim 1 wherein said stiffener rib is formed in a continuous zig-zag pattern.

3. The threshold of claim 1 wherein said sill apertures contain an insert to retain threaded elongate members.

4. The threshold of claim 3 further comprising a sill retained in said U-shaped channel by threaded elongate members retained in said sill aperture inserts.

5. The threshold of claim 1 which contains thermal expansion joints.

6. The threshold of claim 1 wherein said end channels are formed from said bottom of said threshold.

7. The threshold of claim 1 further comprising inside vent apertures.

8. The threshold of claim 1 wherein the floor of said U-shaped channel contains an aperture for water in said channel to flow to within said threshold, and another aperture where the floor meets said tread segment for water within the threshold to flow to the outside.

9. A blow-molded thermoplastic threshold for attaching to a jamb assembly comprising at least two vertical jambs and a lower horizontal jamb, and having an inside and an outside, which comprises:

a hollow, sealed to the outside threshold made by blow-molding a parison of thermoplastic material, and having a bottom adapted to rest on a lower horizontal jamb and having a stiffener rib disposed thereat;

an integral planar tread segment disposed to the outside; and a sill disposed to the inside which is connected to said planar tread segment by a sloping wall, the bottom or top adjacent each sealed threshold end containing an end channel parallel to each end and adapted to present with each said end at least two walls for said threshold to be attached to vertical side jambs for its installation.

10. The threshold of claim 9 wherein said stiffener rib is formed in a continuous zig-zag pattern.

11. The threshold of claim 9 which contains thermal expansion joints.

12. The threshold of claim 9 wherein said end channels are formed from said bottom of said threshold.

13. The threshold of claim 9 further comprising inside vent apertures.

14. The threshold of claim 9 which additionally contains adjacent to said sill, a transverse U-shaped channel having upstanding inside and outside disposed vertical channel walls, said channel adapted to receive an adjustable sill and having adjustable sill apertures for receiving threaded elongate members for adjusting the height of said adjustable sill, the outside disposed vertical channel wall being joined about its top to an outer, sloping wall that meets said tread segment.

* * * * *